US005979730A

United States Patent [19]

Yuta et al.

[11] Patent Number: 5,979,730

[45] Date of Patent: Nov. 9, 1999

[54] MOUNTING BEAM REMOVAL EQUIPMENT

[75] Inventors: Hiroaki Yuta; Kenichi Nakaura, both of Mitaka, Japan

[73] Assignee: Tokyo Seimitsu Co., Ltd., Tokyo, Japan

[21] Appl. No.: 08/885,875

[22] Filed: Jun. 30, 1997

[30] Foreign Application Priority Data

Jul. 16, 1996 [JP] Japan ..... 8-186159

[51] Int. Cl.[6] ..... B26F 3/00

[52] U.S. Cl. ..... 225/103; 225/97; 225/96.5; 225/102; 225/2; 83/170; 83/15; 29/426.4

[58] Field of Search ..... 225/2, 93, 97, 225/103, 102, 96.5; 125/23.01, 23.02, 16.02; 83/15, 22, 170, 929.2; 29/426.4, 700, 418

[56] References Cited

U.S. PATENT DOCUMENTS 4,858,804 8/1989 Sharp, Jr. ..... 225/97 X

*Primary Examiner*—Rinaldi I. Rada
*Assistant Examiner*—Boyer Ashley
*Attorney, Agent, or Firm*—Sixbey, Friedman, Leedom & Ferguson; David S. Safran

[57] ABSTRACT

A mounting beam removal equipment has a cassette for holding a plurality of stacked wafers in such a manner that mounting beams of the wafers are trued up in the same direction, a brush composed of a plurality of disks which are inclined at a predetermined angle and secured to a vertical shaft along an axis of the vertical shaft at regular intervals, the brush facing a side of the mounting beams of the wafers held in said cassette. Furthermore, a rotation driving device is provided for rotating the brush about the axis of said vertical shaft, a first moving device is provided for moving the brush horizontally along the side of the mounting beams, and a second moving device is provided for moving the brush horizontally in a direction perpendicular to the side of the mounting beams. The second moving device moves the brush to the side of the mounting beams and brings the disks of the brush into contact with the side of the mounting beams, and the disks of the brush remove the mounting beams from said wafers while the rotation driving device rotates the brush and the first moving device moves the brush along the side of the mounting beams.

6 Claims, 7 Drawing Sheets

MOUNTING BEAM REMOVAL EQUIPMENT

BACKGROUND OF THE INVENTION

1. Field of the Invention

The present invention relates to mounting beam removal equipment, and more particularly to mounting beam removal equipment for removing mounting beams from a plurality of wafers simultaneously.

2. Description of the Related Art

When a slicing machine slices an ingot, a mounting beam is mounted on the peripheral surface of the ingot in order to prevent the cutting face from chipping. Since the ingot is sliced along with the mounting beam, the mounting beam is attached to the sliced wafer. The mounting beam must be removed from the wafer.

In order to remove the mounting beam from the wafer, a variety of methods have been proposed: a water heating method, a heating method and a drying method. Concerning all methods, the wafers are processed on a wafer-by-wafer basis. For this reason, the wafers cannot be efficiently processed, and it takes much time to process the wafers.

SUMMARY OF THE INVENTION

The present invention has been developed in view of the above-described circumstances, and has its object the provision of mounting beam removal equipment which can remove mounting beams from a number of wafers simultaneously.

To achieve the above-mentioned object, the present invention comprises: a cassette for holding a plurality of stacked wafers in such a manner that mounting beams turn in the same direction; a brush composed of a plurality of disks secured to a shaft along an axis at regular intervals, the disks being inclined at a predetermined angle, the brush being located at a position facing the mounting beams of the wafers held in the cassette; first moving means for moving the brush back and forth horizontally with respect to the mounting beams and along the width of the mounting beams; second moving means for advancing and retreating the brush horizontally with respect to the mounting beams in a direction perpendicular to the width of the mounting beams; and in the present invention, the brush approaches the mounting beams while rotating and moving back and forth along the width of the mounting beams, so that the disks of the brush contact the mounting beams, and the mounting beams are removed from the wafers by a force of the contact.

According to the present invention, the rotating brush moves toward the mounting beams while the brush is moving back and forth along the width of the mounting beams. Thereby, a plurality of disks provided at the brush contacts the mounting beams, and the mounting beams are removed from the wafers by a force of the contact.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
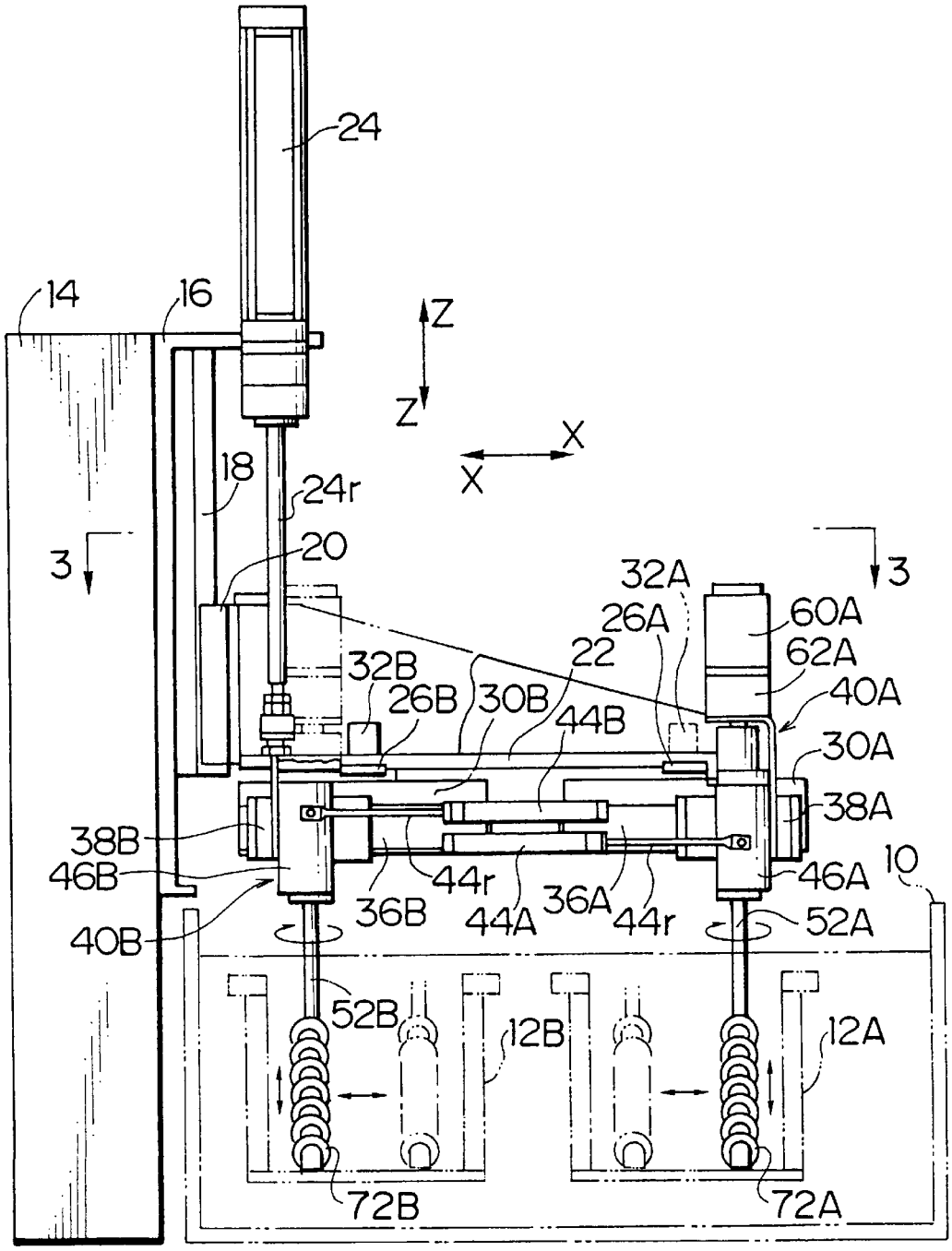
FIG. 1 is a side view illustrating an embodiment of mounting beam removal equipment.
Figure 2:
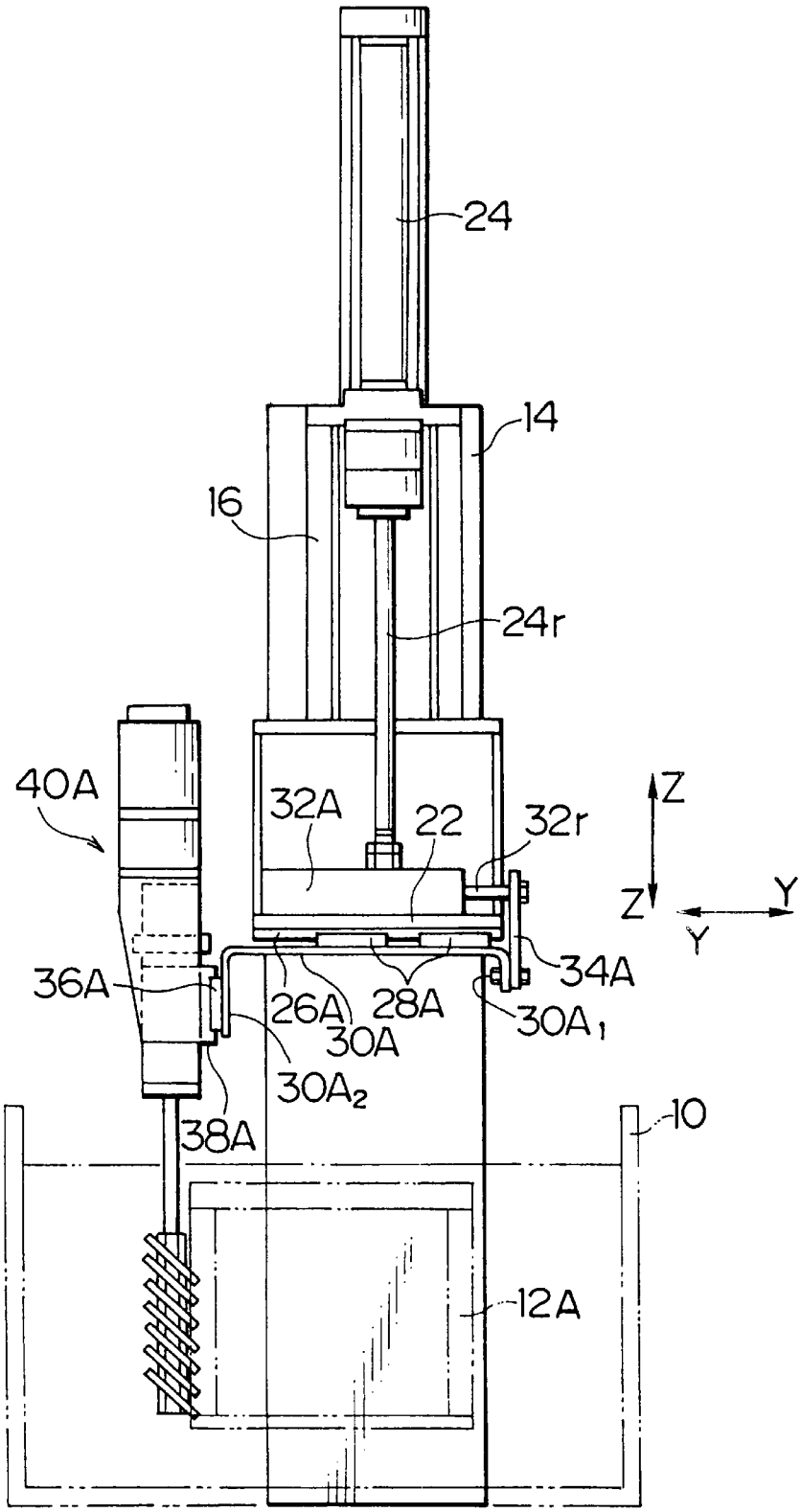
FIG. 2 is a front view of the mounting beam removal equipment in FIG. 1.
Figure 3:
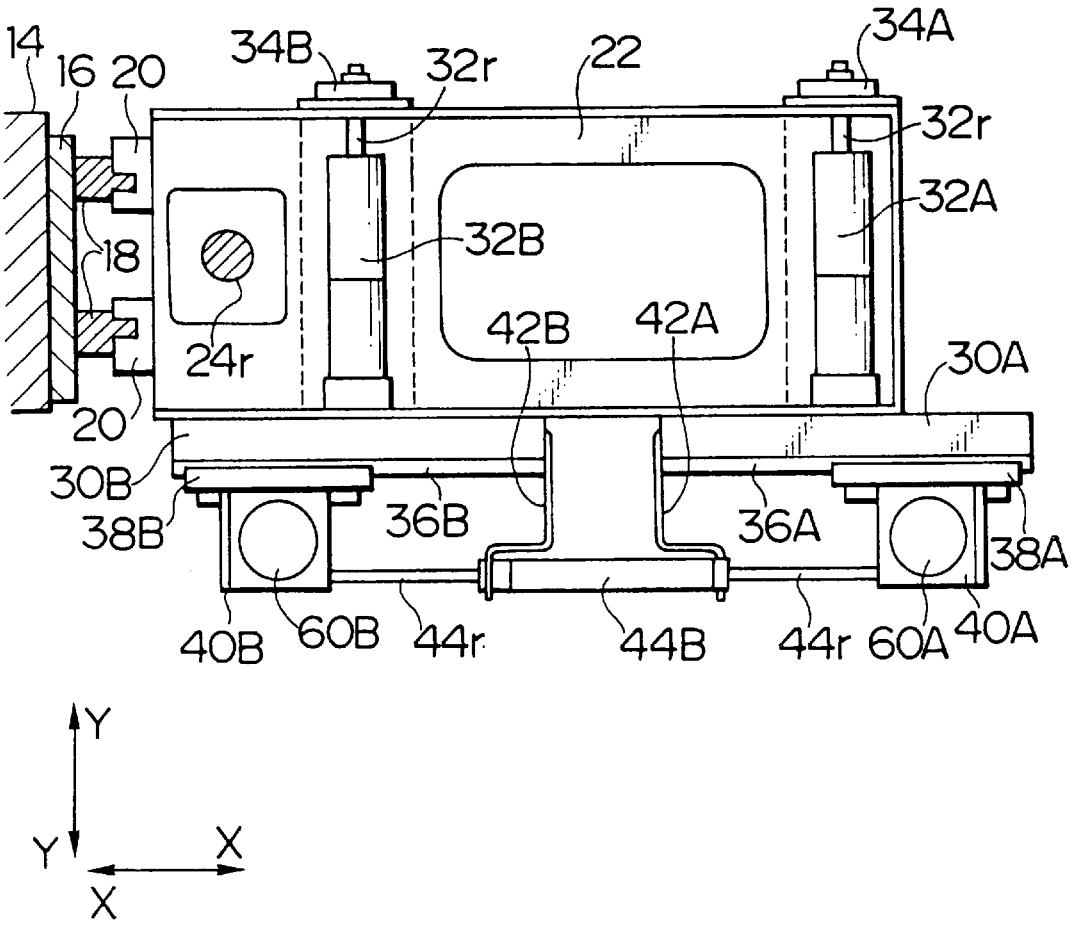
FIG. 3 is a sectional view taken on line 3—3 of FIG. 1.

FIGS. 1, 2 and 3 illustrate mounting beam removal equipment according to the present invention. FIG. 1 is a front view; FIG. 2 is a side view; and FIG. 3 is a sectional view taken on line 3—3 of FIG. 1.

Figure 7:
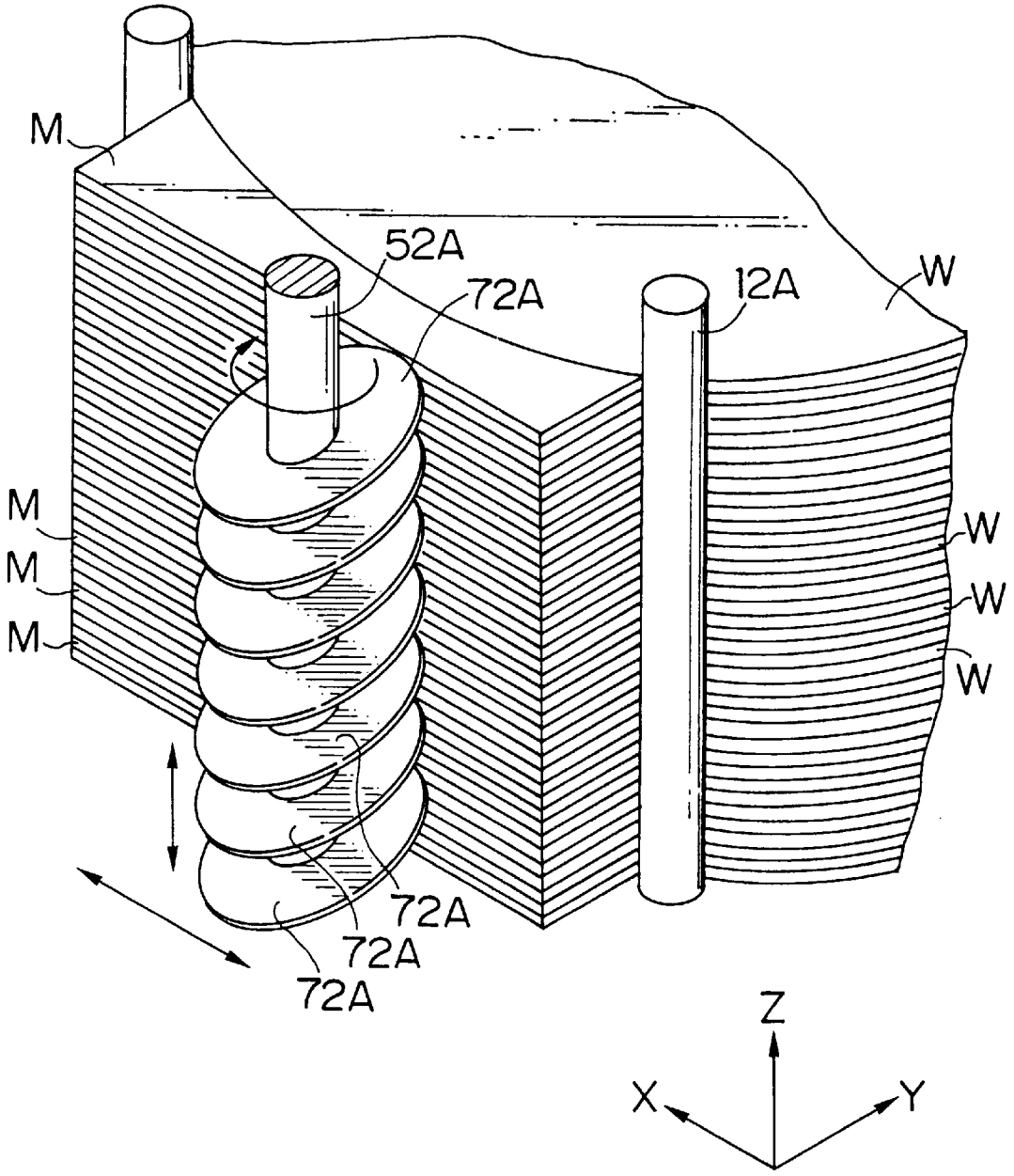
FIG. 7 is a view describing the operation of the brush equipment.

As depicted in FIGS. 1 and 2, a pair of cassettes 12A, 12B are placed at predetermined positions within a tank 10, which contains hot water. As indicated in FIG. 7, a number of wafers W are accommodated in the cassettes 12A, 12B such that mounting beams M of the wafers W are trued up in the same direction.

A column 14 is vertically positioned in a close proximity to the tank 10. A guide rail 18 is arranged at the column 14 via an installing block 16, which is reversely L-shaped. A lift table 22 is supported by the guide rail 18 via a slider 20 in such a manner as to move up and down freely.

A hydraulic cylinder 24 is supported by the top end of the installing block 16 along the guide rail 18, and the end of a rod 24*r* of the hydraulic cylinder 24 connects to the top of the lift table 22. Thus, when the hydraulic cylinder 24 is driven, the lift table 22 is moved up and down along the guide rail 18.

As indicated in FIGS. 2 and 3, guide rails 26A and 26B are arranged in the direction Y—Y in a proximity to both ends of the bottom face of the lift table 22. Slide frames 30A, 30B are slidably supported by the guide rails 26A, 26B, respectively via sliders 28A, and corresponding sliders on frame 30B.

In a proximity to both ends of the top face of the lift table 22, hydraulic cylinders 32A, 32B are placed along the guide rails 26A, 26B which are provided at the bottom of the lift table 22. Rods 32*r* of the hydraulic cylinders 32A, 32B are connected to the slide frames 30A, 30B via connecting members 34A, 34B. Thus, when the hydraulic cylinders 32A, 32B are driven, the slide frames 30A, 30B slide in the direction Y—Y along the guide rails 26A, 26B.

The slide frames 30A, 30B are T-shaped, and both ends of them are vertically bent down. The connecting members 34A, 34B, which connect the rods 32*r* of the hydraulic cylinders 32A, 32B, are connected to a bent part $\mathbf{30A}_1$ at the foot of the slide frame 30A (right side of FIG. 2) and by a corresponding bent part at the foot of the slide frame 30B. Guide rails 36A, 36B are arranged in the direction X—X on a bent part $\mathbf{30A}_2$, at the head of the slide frame 30A (left side of FIG. 2) and by a corresponding bent part at the head of the slide frame 30B. Brush equipment 40A, 40B are slidably supported by the guide rails 36A, 36B via sliders 38A, 38B.

As depicted in FIGS. 1 and 3, hydraulic cylinders 44A, 44B are provided at the slide frames 30A, 30B via supporting members 42A, 42B. The hydraulic cylinders 44A, 44B are placed along the guide rails 36A, 36B, and rods 44*r* of the hydraulic cylinders 44A, 44B are connected to the brush equipment 40A, 40B. Thus, when the hydraulic cylinders 44A, 44B are driven, the brush equipment 40A, 40B slide along the guide rails 36A, 36B.

Figure 4:
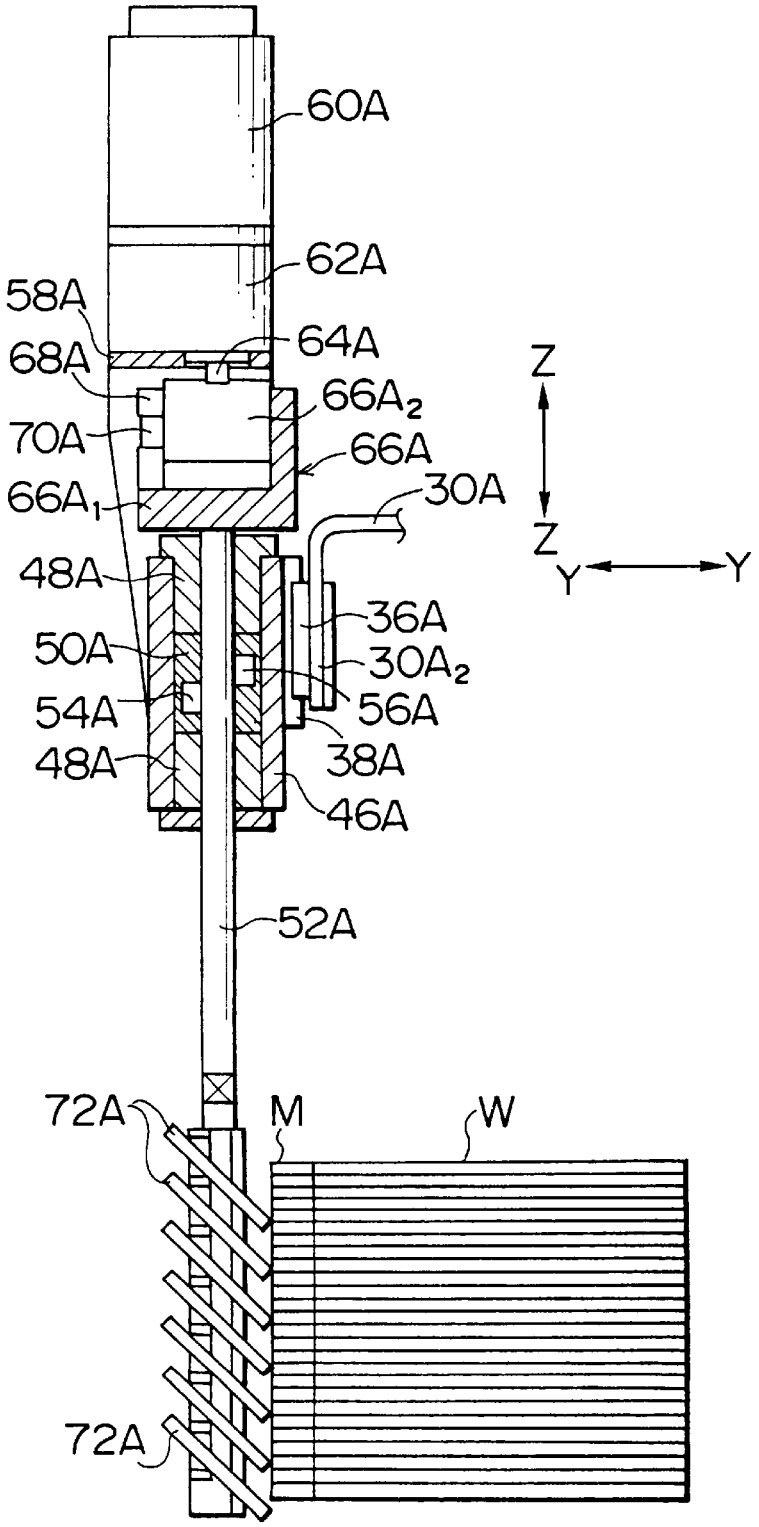
FIG. 4 is a side view illustrating the construction of brush equipment.
Figure 5:
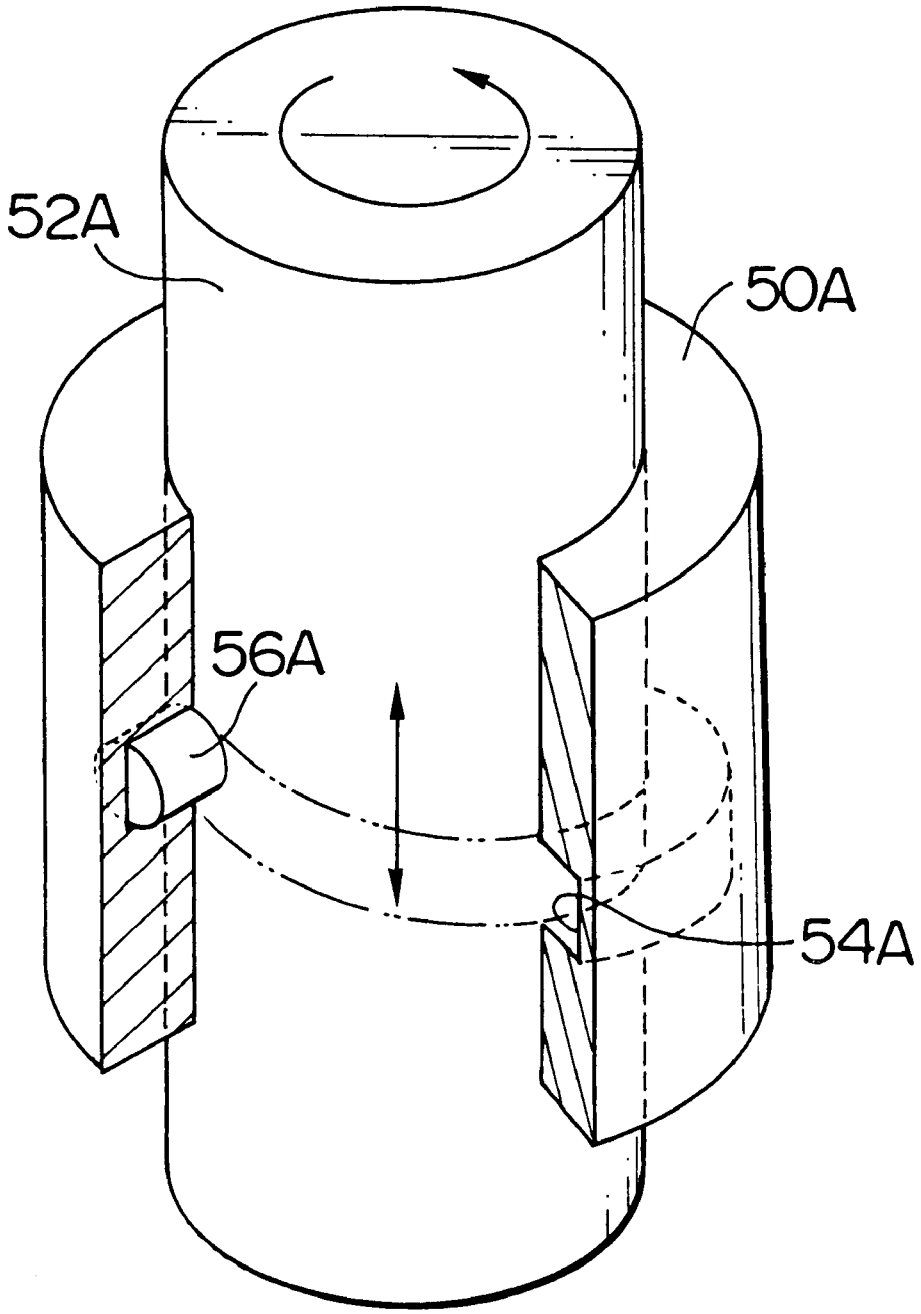
FIG. 5 is a perspective view illustrating the construction of a cam cylinder.

FIG. 4 is a side view illustrating the construction of the brush equipment 40A. As indicated in FIG. 4, a columnar supporting block 46A is secured to the slider 38A sliding on the guide rail 36A. A shaft 52A is slidably supported by the inner periphery of the supporting block 46A via bushes 48A and a cam cylinder 50A. A similar arrangement is provided for the brush equipment 40B which is shown in FIG. 1 with a columnar supporting block 46B secured to the slider 38B and supporting shaft 52B.

A cam groove 54A is formed at the inner periphery of the cam cylinder 50A. The cam groove 54A is engaged with a cam follower 56A, which is secured to the peripheral surface of the shaft 52A. When the shaft 52A rotates, the cam follower 56A slides along the cam groove 54A, and the shaft 52A vertically vibrates as a result. The cam cylinder 50A is prevented from rotating in a circumferential direction with a key (not shown).

A motor 60A is placed above the supporting block 46A via a bracket 58A. The rotation of the motor 60A is transmitted to a spindle 64A via a reducer 62A, and the rotation of the spindle 64A is transmitted to the shaft 52A via a joint 66A.

The joint 66A is constructed in a manner described below so as to prevent the vibration of the shaft 52A from being transmitted to the spindle 64A.

Figure 6:
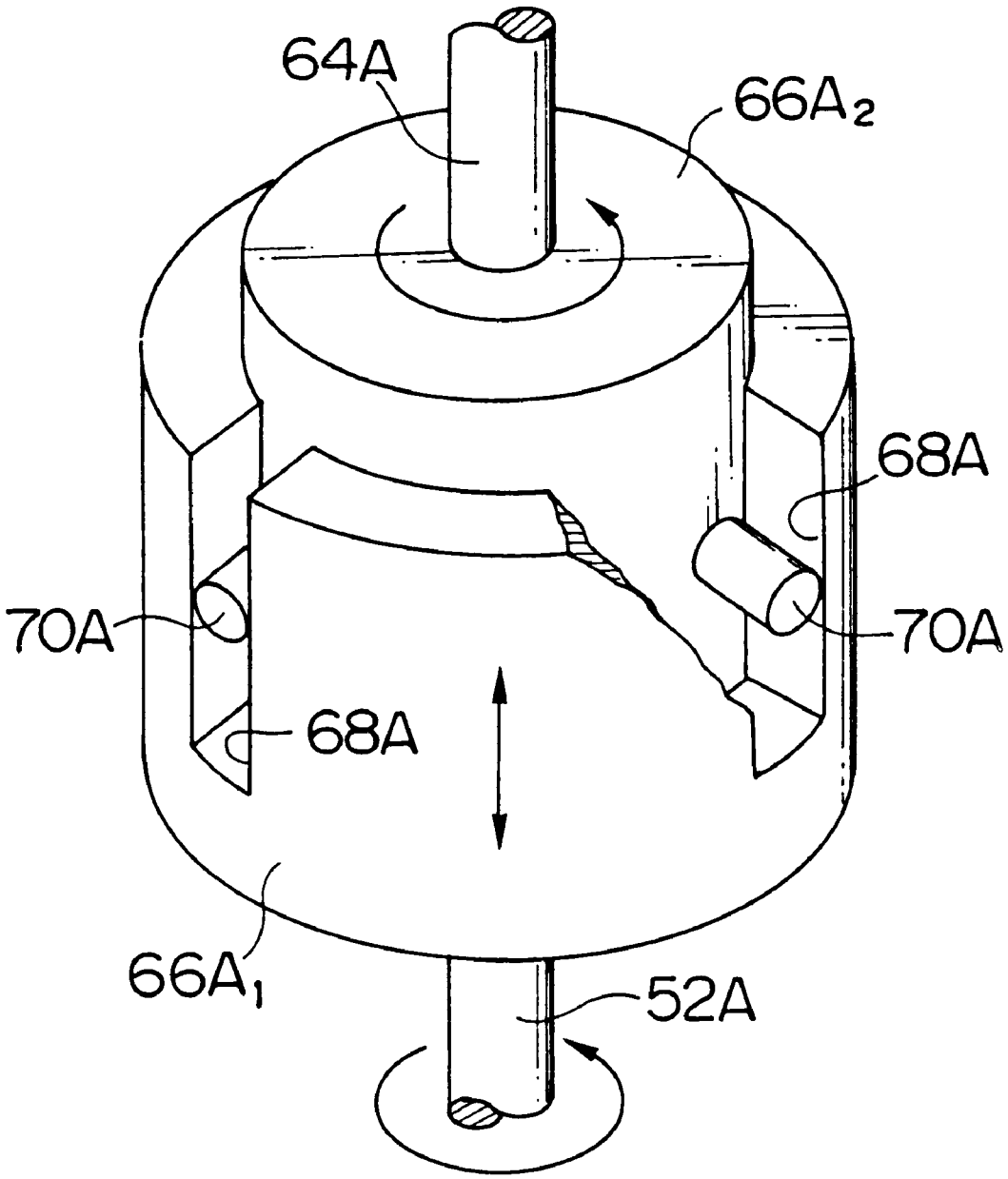
FIG. 6 is a perspective view illustrating the construction of a joint.

As illustrated in FIG. 6, the joint 66A is constructed in such a manner that a columnar member $66A_2$ is engaged with a cylindrical member $66A_1$. Three cam grooves 68A are formed along the axis on the cylindrical member $66A_1$. Cam followers 70A are secured to the peripheral surface of the columnar member $66A_2$, and the cam followers 70A are engaged with the cam grooves 68A. The cam followers 70A slide along the cam grooves 68A, thereby preventing the vibration of the shaft 52A from being transmitted to the spindle 64A.

As shown in FIG. 4, seven disks 72A are secured to the lower section of the shaft 52A at regular intervals. The seven disks 72A are secured to the shaft 52A in such a manner that they are inclined 45° with respect to the axis of the shaft 52A. The disks 72A rotate and vibrate in connection with the shaft 52A. The disks 72A are made of elastic material such as plastic, rubber, urethan rubber, or the like.

Because the brush equipment 40B has the same construction as the above-stated brush equipment 40A, the brush equipment 40B will not be explained.

An explanation will hereunder be given about the operation of an embodiment for the slice base removal equipment which is constructed in the above-mentioned manner.

First, an explanation will be given about the operation of the brush equipment 40A, 40B.

When the motors 60A, 60B are driven, the shafts 52A, 52B rotate and vertically vibrate. While the shafts 52A, 52B rotate and vibrate, the seven disks 72A, 72B, which are secured to the lower section of the shafts 52A, 52B, vibrate and rotate on the shafts 52A, 52B.

When the hydraulic cylinders 44A, 44B are driven, the brush equipment 40A, 40B slide on guide rails 36A, 36B which are provided at the slide frames 30A, 30B, and thereby the brush equipment 40A, 40B move back and forth in the direction X—X in FIG. 1.

On the other hand, when the hydraulic cylinders 32A, 32B are driven, the slide frames 30A, 30B slide on the guide rails 26A, 26B which are provided on the lift table 22, and thereby the slide frames 30A, 30B move back and forth in the direction Y—Y in FIG. 2. Thus, the brush equipment 40A, 40B also move back and forth in the direction Y—Y in FIG. 2 while the slide frames 30A, 30B are moving.

When the hydraulic cylinder 24 is driven, the lift table 22 slides on the guide rail 18 which is provided at the column 14, and thereby the lift table 22 moves back and forth in the direction Z—Z in FIG. 1. Thus, the brush equipment 40A, 40B move back and forth in the direction Z—Z in FIG. 2 while the lift table 22 is moving.

As stated above, the brush equipment 40A, 40B move back and forth in the direction X-Y-Z.

Next, an explanation will be given about a mounting beam removing method performed by the mounting beam removing equipment according to the present invention.

First, a predetermined number of wafers W are held in the cassettes 12A, 12B in such a manner that the mounting beams M are trued up in the same direction. Then the cassettes 12A, 12B containing the wafers W are placed at a predetermined position in the tank 10, which contains the hot water. Prior to this, the brush equipment 40A, 40B are pulled out of the tank 10.

Thus, the cassettes 12A, 12B placed at a predetermined position in the tank 10 are arranged in such a manner that the mounting beams M of the contained wafers W are parallel to the direction X—X in the drawings.

Next, the hydraulic cylinder 24 is driven to move down the brush equipment 40A, 40B. When the brush equipment 40A, 40B has moved down to the lowest points, the disks 72A, 72B of the brush equipment 40A, 40B are positioned in such a manner as to face the mounting beams M of the wafers W contained in the cassettes 12A, 12B. At that time, the brush equipment 40A, 40B are located at the farthermost positions from the cassettes 12A, 12B in the direction Y—Y.

When the brush equipment 40A, 40B reach the lowest points, the motors 60A, 60B of the brush equipment 40A, 40B are started. Thereby, the disks 72A, 72B of the brush equipment 40A, 40B rotate and vibrate.

When the motors 60A, 60B are started, the hydraulic cylinders 32A 32B, 36A, 36B are started. Thereby, the brush equipment 40A, 40B advances to the mounting beams M (in the direction Y—Y) while moving back and forth along the width of the mounting beams M (in the direction X—X).

Thus, the disks 72A, 72B of the brush equipment 40A, 40B move back and forth along the width of the slice bases M while rotating and vibrating, and they gradually approach the mounting beams M as shown in FIG. 7.

The disks 72A, 72B approach the mounting beams M, and they contact the mounting beams M. Since the disks 72A, 72B are rotating and vibrating, the horizontal and vertical bending forces, which result from the rotation and vibration of the disks 72A, 72B contacting the mounting beams M, act on the mounting beams M.

Since the disks 70A, 70B gradually move toward the mounting beams M while moving back an forth along the mounting beams M, the bending forces become stronger gradually.

Furthermore, since the disks 72A, 72B are vibrating, the bending forces act uniformly on all the wafers W contained in the cassettes 12A, 12B.

Thus, the mounting beams M can be removed from all the wafers W accommodated in the cassettes 12A, 12B without applying a force on the wafers W.

When the mounting beams M are removed from all the wafers W, the brush equipment 40A, 40B retreat from the wafers W in the direction Y—Y, and the motors 60A, 60B stop and the rotation and vibration of the disks 72A, 72B stop, too. At the same time, the lift table 22 moves up, and the brush equipment 40A, 40B are pulled out of the tank 10.

The operation of removing the mounting beams M is completed by the above-stated processes, and the wafers W from which the mounting beams M are removed are retrieved from the tank 10 by a wafer retriever (not shown).

As described above, according to the slice base removal equipment of this embodiment, the mounting beams M can be removed from a number of wafers W simultaneously, and the wafers can be processed much more efficiently than in the conventional equipment which removes the mounting beams from the wafers on a wafer-by-wafer basis.

Moreover, the rotating and vibrating disks 72A, 72B gradually move toward the mounting beams M while the disks 72A, 72B are moving back and forth along the width of the mounting beams M, so that the mounting beams M can be removed from the wafers W without applying a force on the wafers W excessively. Thus, the mounting beams M can be removed from the wafers W without the problem that the wafers W will chip or get damaged.

In this embodiment, the disks 72A, 72B vertically vibrate so that the mounting beams M can be effectively removed from the wafers W. The disks 72A, 72B, however, may only rotate and remove the mounting beams M without vibrating.

Moreover, in this embodiment, the seven disks 72A, 72B are attached; however, the number of attached disks varies according to the number of wafers W to be processed (depending on the capacity of the cassettes 12A, 12B, which hold the wafers W).

Further, in this embodiment, the two brush equipment 40A, 40B are used so as to improve the processing efficiency; however, two or more brush equipment may be used at the same time so as to further improve the processing efficiency.

Further, in this embodiment, a number of wafers W are processed at the same time; however, the present invention may be applied to a processing of wafers W one by one. In this case, the wafers W can be processed without applying an unreasonable force, and thus, the wafers W can be prevented from chipping or getting damaged.

Furthermore, in this embodiment, the rotating and vibrating disks 72A, 72B gradually approach the mounting beams M while moving back and forth along the width of the mounting beams M. Accordingly, the force applied to the mounting beams M is strengthened, so that the mounting beams M can be removed from the wafers W. If the mounting beams M are not removed from the wafers W, the resistance applied to the disks 72A, 72B gradually becomes stronger.

For the reasons stated above, the brush equipment 40A, 40B are constructed in such a manner that if the resistance of greater than a predetermined strength is applied to the disks 72A, 72B, the disks 72A, 72B stop moving. Thereby, the wafers W can be effectively prevented from chipping or getting damaged. Moreover, the stopping of the disks 72A, 72B informs the user that the brush equipment 40A, 40B are malfunctioning.

As set forth hereinabove, according to the present invention, the mounting beams can be removed from many wafers simultaneously, so that the wafers can be processed efficiently. Since the mounting beams are removed from the wafers without applying an unreasonable force on the wafers, the wafers does not chip or get damaged.

It should be understood, however, that there is no intention to limit the invention to the specific forms disclosed, but on the contrary, the invention is to cover all modifications, alternate constructions and equivalents falling within the spirit and scope of the invention as expressed in the appended claims.

We claim:

1. Mounting beam removal equipment comprising:

a cassette for holding a plurality of stacked wafers in such a manner that mounting beams of the wafers are trued up in the same direction;

a brush composed of a plurality of disks secured to a vertical shaft along an axis of said vertical shaft at regular intervals, said disks being inclined at a predetermined angle relative to the vertical shaft, said brush facing a side of said mounting beams of said wafers held in said cassette;

rotation driving means for rotating said brush about the axis of said vertical shaft;

first moving means for moving said brush horizontally in a direction parallel to a widthwise direction of the cassette and along the side of said mounting beams;

second moving means for moving said brush in a direction perpendicular to said widthwise direction of said cassette and to the side of the mounting beams; and wherein said second moving means moves said brush to the side of said mounting beams and brings said disks of said brush into contact with the side of said mounting beams, and said disks of said brush slice said mounting beams from said wafers while said rotation driving means rotates said brush and said first moving means moves said brush along the side of said mounting beams.

2. The mounting beam removal equipment as defined in claim 1, further comprising vibration driving means for vibrating said brush vertically.

3. The mounting beam removal equipment as defined in claim 1, wherein said disks are made of elastic material.

4. The mounting beam removal equipment as defined in claim 1, wherein said disks are inclined 45° to said shaft.

5. The mounting beam removal equipment as defined in claim 1, wherein said cassette is immersed in hot water in a tank.

6. The mounting beam removal equipment as defined in claim 1, further comprising lift means for moving up and down said brush.

* * * * *